US011254022B1

(12) United States Patent
Hooberman

(10) Patent No.: US 11,254,022 B1
(45) Date of Patent: Feb. 22, 2022

(54) RAZOR EXPOSURE

(71) Applicant: Personal Care Marketing and Research, Inc., Marina Del Rey, CA (US)

(72) Inventor: Gideon Hooberman, Marina Del Rey, CA (US)

(73) Assignee: Personal Care Marketing and Research, Inc., Marina Del Rey, CA (US)

( * ) Notice: Subject to any disclaimer, the term of this patent is extended or adjusted under 35 U.S.C. 154(b) by 0 days.

(21) Appl. No.: 17/228,627

(22) Filed: Apr. 12, 2021

Related U.S. Application Data

(63) Continuation of application No. 17/099,681, filed on Nov. 16, 2020, now Pat. No. 11,000,960.

(51) Int. Cl.
*B26B 21/22* (2006.01)
*B26B 21/40* (2006.01)

(52) U.S. Cl.
CPC ..... *B26B 21/227* (2013.01); *B26B 21/4031* (2013.01)

(58) Field of Classification Search
CPC ..... B26B 21/227; B26B 21/40; B26B 21/4012–4031
USPC ..... 30/346.56, 47–51
See application file for complete search history.

(56) References Cited

U.S. PATENT DOCUMENTS 2,138,353 A 11/1938 Victor
3,660,893 A 5/1972 Welsh
3,934,339 A 1/1976 Dawidowicz et al.
3,938,247 A 2/1976 Carbonell et al.
3,964,159 A 6/1976 Ferraro
4,016,648 A 4/1977 Chen et al.
4,026,016 A 5/1977 Nissen
4,057,896 A 11/1977 Trotta
4,063,354 A 12/1977 Oldroyd et al.
4,063,357 A 12/1977 Francis
4,083,104 A 4/1978 Nissen et al.
4,084,316 A 4/1978 Francis
4,094,063 A 6/1978 Trotta
4,146,958 A 4/1979 Chen et al.
4,168,571 A 9/1979 Francis
4,180,907 A 1/1980 Iten
4,198,746 A 4/1980 Trotta
4,200,976 A 5/1980 Gooding
4,247,982 A 2/1981 Booth et al.
(Continued)

FOREIGN PATENT DOCUMENTS

CN 1404433 A 3/2003
CN 1917988 A 2/2007
(Continued)

*Primary Examiner* — Jason Daniel Prone
(74) *Attorney, Agent, or Firm* — DLA Piper LLP (US)

(57) ABSTRACT

Disclosed here are shaving razor systems and methods including razor cartridges with a unitary frame having a length and width, a topside and an underside, wherein the unitary frame includes angled joints or bends connecting at least three guards running lengthwise on the unitary frame, the guards separated by at least three gaps in the frame, and at least three blades, affixed to the underside of the guards of the unitary frame, wherein the at least three blades include edges, and wherein the blade edges extend into the gaps in the frame when affixed to the underside of the guards of the unitary frame.

20 Claims, 12 Drawing Sheets

(56) References Cited

U.S. PATENT DOCUMENTS 4,253,235 A 3/1981 Jacobson
4,253,236 A 3/1981 Jacobson
4,253,237 A 3/1981 Jacobson
4,257,160 A 3/1981 Murai
4,258,471 A 3/1981 Jacobson
4,265,015 A 5/1981 Asano
4,266,340 A 5/1981 Bowman
4,270,268 A 6/1981 Jacobson
4,272,885 A 6/1981 Ferraro
4,275,498 A 6/1981 Ciaffone
4,281,454 A 8/1981 Trotta
4,281,456 A 8/1981 Douglass et al.
4,282,650 A 8/1981 Trotta
4,282,651 A 8/1981 Trotta
4,283,850 A 8/1981 Douglass et al.
4,288,920 A 9/1981 Douglass et al.
4,300,285 A 11/1981 Endo
4,302,876 A 12/1981 Emmett
4,308,663 A 1/1982 Ciaffone
4,309,821 A 1/1982 Terry et al.
4,324,041 A 4/1982 Trotta
4,335,508 A 6/1982 Francis et al.
4,337,575 A 7/1982 Trotta
4,345,374 A 8/1982 Jacobson
4,354,312 A 10/1982 Trotta
4,378,633 A 4/1983 Jacobson
4,378,634 A 4/1983 Jacobson
4,389,773 A 6/1983 Nissen et al.
4,392,303 A 7/1983 Ciaffone
4,395,822 A 8/1983 Ciaffone
4,403,412 A 9/1983 Trotta
4,403,413 A 9/1983 Trotta
4,403,414 A 9/1983 Kiraly et al.
4,407,067 A 10/1983 Trotta
4,411,065 A 10/1983 Trotta
4,413,411 A 11/1983 Trotta
4,422,237 A 12/1983 Trotta
4,428,116 A 1/1984 Chen et al.
4,442,598 A 4/1984 Jacobson
4,443,940 A 4/1984 Francis et al.
4,446,619 A 5/1984 Jacobson
4,486,952 A 12/1984 Trotta
4,488,357 A 12/1984 Jacobson
4,492,024 A 1/1985 Jacobson
4,492,025 A 1/1985 Jacobson
4,498,235 A 2/1985 Jacobson
4,514,904 A 5/1985 Bond
4,551,916 A 11/1985 Jacobson
4,573,266 A 3/1986 Jacobson
4,574,476 A 3/1986 Ortiz
4,586,255 A 5/1986 Jacobson
4,587,729 A 5/1986 Jacobson
4,599,793 A 7/1986 Iten
4,603,477 A * 8/1986 Francis ..... B26B 21/14 30/346.56
4,621,424 A 11/1986 Jacobson
4,739,553 A 4/1988 Lazarchik
4,785,534 A 11/1988 Lazarchik
4,797,998 A 1/1989 Motta
4,868,983 A 9/1989 Francis
4,901,437 A 2/1990 Iten
4,932,122 A 6/1990 Shurland et al.
4,932,123 A 6/1990 Francis
5,016,352 A 5/1991 Metcalf
5,038,472 A 8/1991 Iderosa
5,044,077 A 9/1991 Ferraro et al.
5,056,222 A 10/1991 Miller et al.
5,067,238 A 11/1991 Miller et al.
5,092,042 A 3/1992 Miller et al.
5,107,590 A 4/1992 Burout et al.
5,134,775 A 8/1992 Althaus et al.
5,141,694 A 8/1992 Butlin et al.
5,157,834 A 10/1992 Chen et al.
5,182,858 A 2/1993 Chen
5,191,712 A 3/1993 Crook et al.
5,224,267 A 7/1993 Simms et al.
5,236,439 A 8/1993 Kozikowski
5,249,361 A 10/1993 Apprille, Jr. et al.
D346,042 S 4/1994 Chu
5,313,705 A 5/1994 Rivers et al.
5,313,706 A 5/1994 Motta et al.
5,318,429 A 6/1994 Butlin et al.
5,331,740 A 7/1994 Carson et al.
5,333,383 A 8/1994 Ferraro
5,359,774 A 11/1994 Althaus
5,365,665 A 11/1994 Coffin
5,373,638 A 12/1994 Coffin
5,377,409 A 1/1995 Chen
5,410,812 A 5/1995 Althaus
5,416,974 A 5/1995 Wain
5,426,851 A 6/1995 Gilder et al.
5,430,939 A 7/1995 Johnston
5,456,009 A 10/1995 Wexler
5,526,567 A 6/1996 Carson et al.
5,533,263 A 7/1996 Gilder
5,546,660 A 8/1996 Burout et al.
5,551,153 A 9/1996 Simms
5,557,851 A 9/1996 Ortiz
5,588,211 A * 12/1996 Elul ..... B26B 21/40 30/50
5,630,275 A 5/1997 Wexler
5,661,907 A 9/1997 Apprille, Jr.
5,669,139 A 9/1997 Oldroyd et al.
5,711,076 A 1/1998 Yin et al.
5,761,814 A 6/1998 Anderson et al.
5,784,790 A 7/1998 Carson et al.
5,787,586 A 8/1998 Apprille, Jr. et al.
5,794,343 A 8/1998 Lee et al.
5,794,354 A 8/1998 Gilder
5,802,721 A 9/1998 Wain et al.
5,813,119 A 9/1998 Ferraro et al.
5,813,293 A 9/1998 Apprille, Jr. et al.
5,822,869 A 10/1998 Metcalf et al.
D402,084 S 12/1998 Chen et al.
5,855,071 A 1/1999 Apprille, Jr. et al.
5,903,979 A 5/1999 Oldroyd
5,915,791 A 6/1999 Yin et al.
5,918,369 A 7/1999 Apprille, Jr. et al.
5,953,819 A 9/1999 Simms et al.
5,953,824 A 9/1999 Ferraro et al.
5,953,825 A 9/1999 Christman et al.
5,956,851 A 9/1999 Apprille, Jr. et al.
D415,315 S 10/1999 Swanson et al.
6,009,624 A 1/2000 Apprille, Jr. et al.
6,026,577 A 2/2000 Ferraro
6,029,354 A 2/2000 Apprille, Jr. et al.
6,035,537 A 3/2000 Apprille, Jr. et al.
D422,751 S 4/2000 Gray
6,044,542 A 4/2000 Apprille, Jr. et al.
D424,744 S 5/2000 Coffin et al.
6,112,412 A 9/2000 Richard
6,115,924 A 9/2000 Oldroyd
6,122,826 A 9/2000 Coffin et al.
6,138,361 A 10/2000 Richard et al.
6,165,456 A 12/2000 Barnet et al.
6,173,498 B1 1/2001 Warrick et al.
6,182,365 B1 2/2001 Tseng et al.
6,182,366 B1 2/2001 Richard
6,212,777 B1 4/2001 Gilder et al.
6,216,349 B1 4/2001 Gilder et al.
6,216,561 B1 4/2001 Dischler
6,233,829 B1 5/2001 Oglesby et al.
6,266,884 B1 7/2001 Prochaska
6,276,062 B1 8/2001 Prochaska
6,295,734 B1 10/2001 Gilder et al.
6,298,557 B1 10/2001 Gilder
6,305,084 B1 10/2001 Zucker
6,311,400 B1 11/2001 Hawes et al.
6,317,990 B1 11/2001 Ferraro
6,381,857 B1 5/2002 Oldroyd
6,393,706 B1 5/2002 Ferraro
6,430,818 B1 8/2002 Wonderley
6,434,839 B1 8/2002 Lee et al.
6,502,318 B1 1/2003 Gilder

(56) References Cited

U.S. PATENT DOCUMENTS 6,516,518 B1 2/2003 Garraway et al.
6,550,141 B1 4/2003 Rivers et al.
6,560,881 B2 5/2003 Coffin
6,584,696 B2 7/2003 Ferraro
6,601,303 B2 8/2003 Gilder et al.
6,612,040 B2 9/2003 Gilder
6,615,498 B1 9/2003 King et al.
6,651,342 B1 11/2003 Walker, Jr.
D484,275 S 12/2003 Prochaska
6,655,029 B2 12/2003 Saito
6,675,479 B1 1/2004 Walker et al.
6,769,180 B2 8/2004 Coffin
6,772,523 B1 8/2004 Richard et al.
6,792,682 B2 9/2004 Folio et al.
6,807,739 B2 10/2004 Folio
D499,843 S 12/2004 Nakasuka
6,839,968 B2 1/2005 Brown et al.
6,854,188 B1 2/2005 Wonderley
6,877,227 B2 * 4/2005 Santhagens Van Eibergen ..... B26B 21/227 30/50
6,880,253 B1 4/2005 Gyllerstrom
6,935,032 B2 8/2005 Folio
6,941,659 B2 9/2005 Gilder
D514,253 S 1/2006 Gray
6,990,740 B2 1/2006 Folio et al.
D516,243 S 2/2006 Nakasuka
7,024,776 B2 * 4/2006 Wain ..... B26B 21/227 30/50
7,043,840 B2 5/2006 Walker et al.
7,047,646 B2 * 5/2006 Coffin ..... B26B 21/4031 30/50
D524,986 S 7/2006 Prudden, Jr.
D526,089 S 8/2006 Fischer et al.
7,086,160 B2 8/2006 Coffin et al.
7,111,401 B2 9/2006 Richard
7,137,205 B2 11/2006 Royle
7,140,116 B2 11/2006 Coffin
D533,684 S 12/2006 Gray et al.
7,152,512 B1 12/2006 Prochaska
D535,784 S 1/2007 Wonderley et al.
7,168,173 B2 1/2007 Worrick, III
7,191,523 B2 3/2007 Miyazaki et al.
7,197,825 B2 4/2007 Walker et al.
7,200,937 B2 4/2007 Richard et al.
7,200,938 B2 4/2007 Lembke
7,200,942 B2 4/2007 Richard
7,210,229 B2 5/2007 Coffin
D547,494 S 7/2007 Watson et al.
7,266,895 B2 9/2007 Pennell et al.
7,272,991 B2 9/2007 Aviza et al.
D556,378 S 11/2007 Watson et al.
D560,034 S 1/2008 Fischer et al.
D563,043 S 2/2008 Ramm
D563,044 S 2/2008 Ramm
7,331,107 B2 2/2008 Folio et al.
D575,454 S 8/2008 Keene et al.
7,448,135 B2 11/2008 Zhuk et al.
7,461,458 B2 12/2008 Peyser et al.
7,469,477 B2 12/2008 Coffin
7,475,483 B2 1/2009 Peyser et al.
D588,309 S 3/2009 Wonderley et al.
D588,744 S 3/2009 Fischer et al.
D588,745 S 3/2009 Fischer et al.
7,526,869 B2 5/2009 Blatter et al.
7,540,087 B2 6/2009 Rawle
7,540,088 B2 6/2009 Takeshita
7,574,809 B2 8/2009 Folio et al.
7,578,062 B2 8/2009 Blackbum
D601,753 S 10/2009 Cataudella et al.
7,607,230 B2 10/2009 Aviza et al.
D604,904 S 11/2009 Watson
7,617,607 B2 11/2009 Pennell et al.
7,621,203 B2 * 11/2009 Aviza ..... B26B 21/227 30/50
7,669,335 B2 3/2010 Walker et al.
7,676,929 B2 3/2010 Lembke et al.
7,681,314 B2 3/2010 Folio
7,685,720 B2 3/2010 Efthimiadis et al.
7,690,122 B2 4/2010 Worrick et al.
D617,946 S 6/2010 Lukan et al.
D617,947 S 6/2010 Lukan et al.
D617,948 S 6/2010 Lukan et al.
D617,949 S 6/2010 Lukan et al.
7,739,797 B2 6/2010 Rawle
7,765,700 B2 * 8/2010 Aviza ..... B26B 21/4068 30/50
7,770,294 B2 8/2010 Bruno et al.
7,802,368 B2 9/2010 Coffin et al.
D625,049 S 10/2010 Bridges et al.
D625,883 S 10/2010 Wonderley
7,810,240 B2 10/2010 Lee et al.
7,811,553 B2 10/2010 O'Grady et al.
D629,564 S 12/2010 Jung
D630,378 S 1/2011 Jung
D630,797 S 1/2011 Witkus
D631,198 S 1/2011 Adams et al.
D633,253 S 2/2011 Wonderley et al.
D633,254 S 2/2011 Witkus
7,877,879 B2 2/2011 Nakasuka
D634,474 S 3/2011 Wilby
7,895,754 B2 3/2011 Richard
7,913,393 B2 3/2011 Royle et al.
D635,717 S 4/2011 Furtek
D636,532 S 4/2011 Jessemey et al.
D639,507 S 6/2011 Furtek
D640,415 S 6/2011 Wonderley et al.
7,966,731 B2 6/2011 Walker et al.
D643,976 S 8/2011 Wonderley et al.
D643,977 S 8/2011 Wonderley et al.
7,992,304 B2 8/2011 Nakasuka
8,033,023 B2 10/2011 Johnson et al.
D648,075 S 11/2011 Wonderley et al.
D648,076 S 11/2011 Jessemey et al.
8,046,920 B2 * 11/2011 Nakasuka ..... B26B 21/227 30/50
D653,395 S 1/2012 Adams et al.
8,096,054 B2 1/2012 Denkert et al.
8,104,179 B2 1/2012 Nakasuka
8,104,184 B2 1/2012 Walker
8,117,753 B2 2/2012 Gilder et al.
8,146,255 B2 4/2012 Denkert et al.
8,151,472 B2 4/2012 Dimitris et al.
D658,809 S 5/2012 Jessemey et al.
8,186,062 B2 5/2012 Fischer et al.
D661,425 S 6/2012 Cataudella et al.
D661,426 S 6/2012 Wain et al.
D662,661 S 6/2012 Corbeil et al.
8,205,343 B2 6/2012 Winter et al.
8,205,344 B2 6/2012 Stevens
8,209,867 B2 7/2012 Clarke
8,225,510 B2 7/2012 Peterson et al.
D665,130 S 8/2012 Wain et al.
8,234,789 B2 8/2012 Wens et al.
8,281,497 B2 10/2012 Takeba
8,286,354 B2 10/2012 Walker et al.
8,336,212 B2 12/2012 Bozikis et al.
8,359,751 B2 1/2013 Efthimiadis et al.
8,359,752 B2 1/2013 Bridges
8,381,406 B2 2/2013 Miyazaki
8,413,334 B2 4/2013 Walker et al.
8,429,826 B2 4/2013 Clarke
8,438,736 B2 5/2013 Keene et al.
8,448,339 B2 * 5/2013 Walker, Jr. ..... B26B 21/4018 30/50
8,474,144 B2 7/2013 Royle
8,499,459 B2 8/2013 Efthimiadis et al.
8,528,214 B2 * 9/2013 Coffin ..... B26B 21/4012 30/47
8,533,959 B2 9/2013 Davis
8,533,961 B2 9/2013 Nicoll et al.
8,544,177 B2 10/2013 Rawle et al.

(56) References Cited

U.S. PATENT DOCUMENTS 8,555,900 B2 10/2013 Nicoll et al.
8,567,068 B2 10/2013 Luxton
8,590,162 B2 11/2013 Park et al.
D699,892 S 2/2014 Wonderley
8,640,342 B2 2/2014 Murdiga
D701,646 S 3/2014 Jobdevairakkam
8,661,689 B2 3/2014 Fathallah et al.
8,707,562 B2 4/2014 Coffin
8,726,518 B2 5/2014 Bruno
8,726,519 B2 * 5/2014 Clarke ..... B26B 21/4031 30/50
8,732,955 B2 5/2014 Howell et al.
8,732,965 B2 5/2014 Efthimiadis et al.
D707,885 S 6/2014 Cataudella et al.
8,745,882 B2 6/2014 Murdiga et al.
8,745,883 B2 6/2014 Murdiga et al.
8,769,825 B2 7/2014 Howell et al.
8,782,903 B2 7/2014 Clarke et al.
8,789,282 B2 7/2014 Wilson et al.
8,793,880 B2 8/2014 Taub et al.
8,931,176 B2 1/2015 Johnson et al.
8,931,380 B2 * 1/2015 Coffin ..... B26B 21/443 30/41.7
8,938,885 B2 1/2015 Stevens
8,978,258 B2 3/2015 Patel et al.
8,984,756 B2 3/2015 Worrick, III
8,991,058 B2 3/2015 Dimitris et al.
9,015,951 B2 * 4/2015 Howell ..... B26B 21/4031 30/50
D730,578 S 5/2015 Long et al.
9,032,627 B2 5/2015 Dimitris et al.
9,032,631 B2 5/2015 Christie et al.
D731,119 S 6/2015 Daniel et al.
D731,708 S 6/2015 Tucker et al.
9,073,226 B2 7/2015 Szczepanowski et al.
D737,511 S 8/2015 Lettenberger et al.
D737,513 S 8/2015 Lettenberger et al.
D741,008 S 10/2015 Bruno et al.
D741,009 S 10/2015 Bruno et al.
D741,546 S 10/2015 Witkus et al.
D744,165 S 11/2015 Tucker et al.
9,193,077 B2 11/2015 Worrick
9,193,078 B2 11/2015 Worrick, III
9,193,079 B2 11/2015 Howell et al.
D748,856 S 2/2016 Mahony et al.
D749,265 S 2/2016 Cataudella et al.
9,248,579 B2 2/2016 DePuydt et al.
9,259,846 B1 2/2016 Robertson
9,283,685 B2 3/2016 Griffin et al.
9,296,117 B2 3/2016 Fathallah et al.
9,321,182 B2 4/2016 Bridges et al.
9,327,414 B2 5/2016 Szczepanowski et al.
9,333,657 B2 5/2016 Westerhof et al.
9,364,961 B2 6/2016 Lelieveld
9,381,657 B2 7/2016 Ku et al.
D764,100 S 8/2016 Park et al.
D764,101 S 8/2016 Cataudella et al.
D766,505 S 9/2016 Coviello
9,434,079 B2 9/2016 Worrick, III
9,469,038 B2 10/2016 Iaccarino et al.
9,475,202 B2 10/2016 Griffin et al.
9,486,930 B2 11/2016 Provost et al.
9,498,892 B2 11/2016 Nakasuka et al.
D776,875 S 1/2017 Ren
D779,121 S 2/2017 Bruno et al.
9,579,809 B2 2/2017 Hawes
9,586,330 B2 3/2017 Ku et al.
9,623,575 B2 4/2017 Griffin et al.
9,630,331 B2 4/2017 Griffin et al.
9,643,327 B2 5/2017 Stevens et al.
9,656,401 B2 5/2017 Burrowes et al.
9,738,000 B2 8/2017 Ariyanayagam et al.
D811,658 S 2/2018 Cataudella et al.
D816,905 S 5/2018 Zucker
D816,906 S 5/2018 Zucker
D816,908 S 5/2018 Zucker
D816,909 S 5/2018 Zucker
D816,910 S 5/2018 Zucker
D816,912 S 5/2018 Zucker
D829,991 S 10/2018 Zucker
D844,898 S 4/2019 Knapp et al.
D850,722 S 6/2019 Knapp
10,350,773 B2 7/2019 Hill et al.
D867,661 S 11/2019 Ovvadias
10,538,007 B2 1/2020 Zucker
D884,969 S 5/2020 Zucker
D884,970 S 5/2020 Zucker
D884,971 S 5/2020 Zucker
10,780,598 B2 * 9/2020 Park ..... B26B 21/4031
10,870,212 B2 * 12/2020 Treu ..... B26B 21/227
11,000,960 B1 * 5/2021 Hooberman ..... B26B 21/227
2002/0000040 A1 * 1/2002 Gilder ..... B26B 21/4018 30/50
2002/0157259 A1 * 10/2002 Coffin ..... B26B 21/4031 30/50
2002/0184770 A1 12/2002 Peyser
2003/0046819 A1 3/2003 Ferraro et al.
2003/0079348 A1 5/2003 Folio
2003/0204955 A1 * 11/2003 Gilder ..... B26B 21/4031 30/50
2003/0213130 A1 11/2003 Motta
2004/0103538 A1 6/2004 Dansreau et al.
2004/0128835 A1 7/2004 Coffin et al.
2004/0172832 A1 * 9/2004 Clipstone ..... B26B 21/60 30/50
2004/0181949 A1 9/2004 Coffin et al.
2004/0181953 A1 9/2004 Folio et al.
2004/0181954 A1 9/2004 Folio et al.
2004/0200074 A1 * 10/2004 Gilder ..... B26B 21/4031 30/50
2004/0216310 A1 11/2004 Santhagens et al.
2004/0231161 A1 11/2004 Coffin et al.
2004/0255467 A1 12/2004 Lembke et al.
2005/0015991 A1 1/2005 Folio et al.
2005/0039338 A1 2/2005 King et al.
2005/0241162 A1 11/2005 Nicolosi et al.
2006/0026842 A1 * 2/2006 Gilder ..... B26B 21/4031 30/50
2006/0032056 A1 2/2006 Coffin et al.
2006/0070240 A1 4/2006 Fischer
2006/0242847 A1 11/2006 Dansreau et al.
2006/0254056 A1 11/2006 Coffin et al.
2006/0260131 A1 11/2006 Folio
2006/0272155 A1 12/2006 Mehta et al.
2006/0277760 A1 * 12/2006 Lee ..... B26B 21/222 30/50
2006/0283025 A1 12/2006 Folio et al.
2007/0056167 A1 3/2007 Richard et al.
2007/0227008 A1 * 10/2007 Zhuk ..... B26B 21/4031 30/50
2007/0227009 A1 10/2007 Zhuk et al.
2007/0266565 A1 11/2007 Aviza et al.
2008/0034590 A1 2/2008 Prudden et al.
2008/0034593 A1 2/2008 Coffin
2008/0172878 A1 * 7/2008 Luxton ..... B26B 21/4031 30/34.1
2008/0250647 A1 10/2008 Fischer et al.
2008/0256802 A1 10/2008 O'Connor et al.
2009/0071006 A1 3/2009 Bruno
2009/0071007 A1 3/2009 Bruno
2009/0083982 A1 4/2009 Forsdike
2009/0113716 A1 5/2009 Wain et al.
2009/0188112 A1 7/2009 Prochaska et al.
2009/0193659 A1 8/2009 Park et al.
2010/0011588 A1 * 1/2010 Wang ..... B26B 21/4031 30/41
2010/0011590 A1 * 1/2010 DePuydt ..... B26B 21/00 30/50
2010/0154220 A1 6/2010 Nakasuka
2010/0251555 A1 10/2010 Park et al.
2010/0313424 A1 12/2010 Johnson et al.
2011/0094108 A1 4/2011 Wain
2011/0119922 A1 5/2011 Ntavos et al.

(56) References Cited

U.S. PATENT DOCUMENTS

| | | | | |
|---|---|---|---|---|
| 2011/0203113 | A1* | 8/2011 | Wang | B26B 21/4031 30/41 |
| 2011/0232101 | A1 | 9/2011 | Park et al. | |
| 2012/0110857 | A1* | 5/2012 | Peterson | B26B 21/4031 30/50 |
| 2012/0124840 | A1* | 5/2012 | Iaccarino | B26B 21/225 30/50 |
| 2012/0151772 | A1 | 6/2012 | Moon et al. | |
| 2012/0279070 | A1 | 11/2012 | Seo | |
| 2013/0008029 | A1 | 1/2013 | Hill et al. | |
| 2013/0097869 | A1 | 4/2013 | Wang et al. | |
| 2013/0097872 | A1 | 4/2013 | Blatter | |
| 2013/0160305 | A1 | 6/2013 | Howell et al. | |
| 2013/0199346 | A1 | 8/2013 | Psimadas et al. | |
| 2013/0205595 | A1 | 8/2013 | Bykowski et al. | |
| 2013/0269190 | A1 | 10/2013 | Worrick, III | |
| 2013/0312265 | A1 | 11/2013 | Wilson et al. | |
| 2013/0326881 | A1 | 12/2013 | Blatter | |
| 2014/0000114 | A1 | 1/2014 | Wester et al. | |
| 2014/0026424 | A1* | 1/2014 | Oglesby | B26B 21/4031 30/50 |
| 2014/0033551 | A1 | 2/2014 | Szczepanowski et al. | |
| 2014/0068953 | A1 | 3/2014 | Wonderley | |
| 2014/0083265 | A1 | 3/2014 | Provost et al. | |
| 2014/0090254 | A1 | 4/2014 | Wang et al. | |
| 2014/0096402 | A1 | 4/2014 | Nakasuka et al. | |
| 2014/0116211 | A1 | 5/2014 | Griffin et al. | |
| 2014/0123497 | A1* | 5/2014 | Zhuk | B26B 21/22 30/49 |
| 2014/0165800 | A1 | 6/2014 | Griffin et al. | |
| 2014/0237830 | A1 | 8/2014 | Wilson et al. | |
| 2014/0245613 | A1 | 9/2014 | Good et al. | |
| 2014/0259675 | A1* | 9/2014 | Tucker | B26B 21/4012 30/50 |
| 2014/0259677 | A1 | 9/2014 | Coresh | |
| 2014/0283387 | A1 | 9/2014 | Bozikis et al. | |
| 2014/0331500 | A1 | 11/2014 | Ren | |
| 2014/0366381 | A1 | 12/2014 | Phipps et al. | |
| 2015/0013169 | A1 | 1/2015 | Warrick | |
| 2015/0040402 | A1 | 2/2015 | Carneiro et al. | |
| 2015/0090085 | A1 | 4/2015 | Griffin et al. | |
| 2015/0101195 | A1* | 4/2015 | Long | B26B 21/4031 30/50 |
| 2015/0158190 | A1 | 6/2015 | Georgakis et al. | |
| 2015/0190935 | A1 | 7/2015 | Griffin et al. | |
| 2015/0197017 | A1 | 7/2015 | Lettenberger et al. | |
| 2015/0217466 | A1 | 8/2015 | Leicht et al. | |
| 2015/0239137 | A1 | 8/2015 | Davos et al. | |
| 2015/0273708 | A1 | 10/2015 | Haba | |
| 2015/0290819 | A1 | 10/2015 | Giannopoulos et al. | |
| 2015/0314465 | A1 | 11/2015 | Giannopoulos et al. | |
| 2015/0314466 | A1 | 11/2015 | Papadopoulos-Papageorgis et al. | |
| 2016/0001454 | A1 | 1/2016 | Coresh | |
| 2016/0001455 | A1 | 1/2016 | Swenson | |
| 2016/0031101 | A1 | 2/2016 | Fulton | |
| 2016/0082610 | A1 | 3/2016 | Bamundaga | |
| 2016/0096280 | A1 | 4/2016 | Robertson | |
| 2016/0129603 | A1 | 5/2016 | Antoniou et al. | |
| 2016/0158948 | A1 | 6/2016 | Eagleton et al. | |
| 2016/0158950 | A1 | 6/2016 | Griffin et al. | |
| 2016/0167242 | A1* | 6/2016 | Noh | B26B 21/4031 30/50 |
| 2016/0199992 | A1* | 7/2016 | Nicholas | B26B 21/4012 30/538 |
| 2016/0236364 | A1 | 8/2016 | Varenberg et al. | |
| 2016/0279817 | A1 | 9/2016 | Washington et al. | |
| 2016/0297086 | A1 | 10/2016 | Efthimiadis et al. | |
| 2017/0021513 | A1 | 1/2017 | Liberatore | |
| 2017/0028577 | A1 | 2/2017 | Ntavos et al. | |
| 2017/0151684 | A1 | 6/2017 | Bozikis et al. | |
| 2017/0282389 | A1 | 10/2017 | Jolley et al. | |
| 2018/0071931 | A1 | 3/2018 | Walker, Jr. et al. | |
| 2018/0236677 | A1 | 8/2018 | Blatter | |
| 2018/0297226 | A1* | 10/2018 | Kim | B26B 21/4031 |
| 2019/0016001 | A1* | 1/2019 | Zucker | B26B 21/4031 |

FOREIGN PATENT DOCUMENTS

| | | | | |
|---|---|---|---|---|
| CN | 103282166 | A | 9/2013 | |
| CN | 104440969 | A | 3/2015 | |
| CN | 105358295 | A | 2/2016 | |
| DE | 60104558 | T2 | 7/2005 | |
| DE | 10327739 | B4 | 6/2006 | |
| DE | 102004061446 | A1 | 6/2006 | |
| DE | 102010006807 | A1 | 9/2010 | |
| DE | 202011107715 | U1 | 1/2012 | |
| DE | 202013002343 | U1 | 4/2013 | |
| DE | 202013003009 | U1 | 6/2013 | |
| DE | 102013007224 | A1 | 9/2014 | |
| DE | 102013007223 | A1 | 10/2014 | |
| DE | 202014007575 | U1 | 10/2014 | |
| DE | 102013213862 | A1 | 1/2015 | |
| DE | 102015002458 | A1 | 9/2016 | |
| EP | 1332026 | B1 | 7/2004 | |
| EP | 1488894 | A1 | 12/2004 | |
| EP | 1671761 | A1 | 6/2006 | |
| EP | 1847360 | A1 | 10/2007 | |
| EP | 2227360 | A1 | 9/2010 | |
| EP | 2583800 | A1 | 4/2013 | |
| EP | 3075498 | A1 | 10/2016 | |
| EP | 3689559 | A1 * | 8/2020 | B26B 21/4031 |
| EP | 3689559 | A1 | 8/2020 | |
| ES | 2290591 | T3 | 2/2008 | |
| ES | 2342497 | T3 | 7/2010 | |
| ES | 1079011 | U | 4/2013 | |
| GB | 2461054 | A | 12/2009 | |
| GB | 2507971 | A | 5/2014 | |
| IT | PI20110077 | A1 | 1/2013 | |
| JP | H04361782 | A | 12/2012 | |
| JP | 2013099467 | A | 5/2013 | |
| NL | 2013416 | A | 10/2015 | |
| RO | 118269 | B1 | 4/2003 | |
| RU | 2433909 | C1 | 11/2011 | |
| SE | 1230136 | C2 | 5/2014 | |
| TR | 200402255 | T4 | 10/2004 | |
| WO | WO0232632 | A2 | 4/2002 | |
| WO | WO0232633 | A2 | 4/2002 | |
| WO | WO2009066218 | A1 | 5/2009 | |
| WO | WO2009153598 | A1 | 12/2009 | |
| WO | WO2010139618 | A1 | 12/2010 | |
| WO | WO2012005839 | A2 | 1/2012 | |
| WO | WO2012158141 | A1 | 11/2012 | |
| WO | WO2012158142 | A1 | 11/2012 | |
| WO | WO2014075844 | A1 | 5/2014 | |
| WO | WO2014139655 | A2 | 9/2014 | |
| WO | WO2015090385 | A1 | 6/2015 | |
| WO | WO2016036238 | A2 | 3/2016 | |
| WO | WO2016040549 | A1 | 3/2016 | |
| WO | WO2016113553 | A1 | 7/2016 | |

* cited by examiner

RAZOR EXPOSURE

CROSS REFERENCE

This application relates to, claims priority to, and is a Continuation application of U.S. patent application Ser. No. 17/099,681, filed on Nov. 16, 2020 and now issued as U.S. Pat. No. 11,000,960, the entirety of which is hereby incorporated by reference.

TECHNICAL FIELD

This application relates to the field of shaving razors, and geometry of razor blades in shaving razor cartridges.

BACKGROUND

Previously, shaving razors and razor cartridges suffered from inherent drawbacks based on razor geometry. Blade components of the cartridge were built to have the same geometry across cartridges which may have hindered close yet comfortable shaving. Designs are needed that address these drawbacks.

SUMMARY

Systems and methods here include improved razor blade cartridges and manufacture of same. In some examples, a shaving razor system is described including a cartridge housing having a length and width, a topside and an underside, the cartridge housing includes a cap generally across the length of a first side of the topside and a guard generally across the length of a second side of the topside. In some examples alone or in combination the cartridge housing includes at least three blades mounted into the cartridge housing generally across the length of the housing between the cap and the guard. In some examples alone or in combination, each blade including a blade edge, exposure is measured comparing each blade edge against an imaginary exposure reference line drawn across the width from the cap to the guard, the exposure of each of the blade edges is different when measured at different locations along the length of the cartridge. In some examples alone or in combination, wherein exposure is measured comparing each blade edge against an imaginary exposure reference line drawn across the width between the nearest blade, cap, or guard, immediately toward the front of and immediately toward the back one of each of the at least three blades.

BRIEF DESCRIPTION OF THE DRAWINGS

For a better understanding of the embodiments described in this application, reference should be made to the Detailed Description below, in conjunction with the following drawings in which like reference numerals refer to corresponding parts throughout the figures.

DETAILED DESCRIPTION

Reference will now be made in detail to embodiments, examples of which are illustrated in the accompanying drawings. In the following detailed description, numerous specific details are set forth in order to provide a sufficient understanding of the subject matter presented herein. But it will be apparent to one of ordinary skill in the art that the subject matter may be practiced without these specific details. Moreover, the particular embodiments described herein are provided by way of example and should not be used to limit the scope of the invention to these particular embodiments.

Overview

Razor blades and razor cartridges are made with a range of geometry that includes blade spacing, angle, and exposure. Typically, a trade-off between closeness and comfort is discussed when designing a razor cartridge with specific geometries. But although there may be advantages to uniform geometry settings on a particular cartridge arrangement, it may be useful to include variances that would allow for nuances to shaving experience and averages of arrangements may provide positive but subtle effects in geometry arrangements, from blade to blade, from cartridge to cartridge, and for a single blade across a cartridge.

Such variations may aid in an improved shaving experience, especially if multiple strokes are taken over the same area of skin in a shaving operation. As skin is different for each user, and skin flexes and moves during a shaving operation, as well as considering that different areas of the body shaped differently, the variations in exposure or geometry in general, may aid in achieving the best of both worlds, close and comfortable for a broader spectrum of users. By providing different exposures and/or geometries in one cartridge, more users may be satisfied with the geometry provided. The systems and methods described here may be used to produce razor cartridges that include specific geometries, varying geometries, and/or multiple geometries for razor cartridges to take advantage of these variables and provide both close and comfortable shaving experiences.

Razor Cartridge Overview

Figure 1:
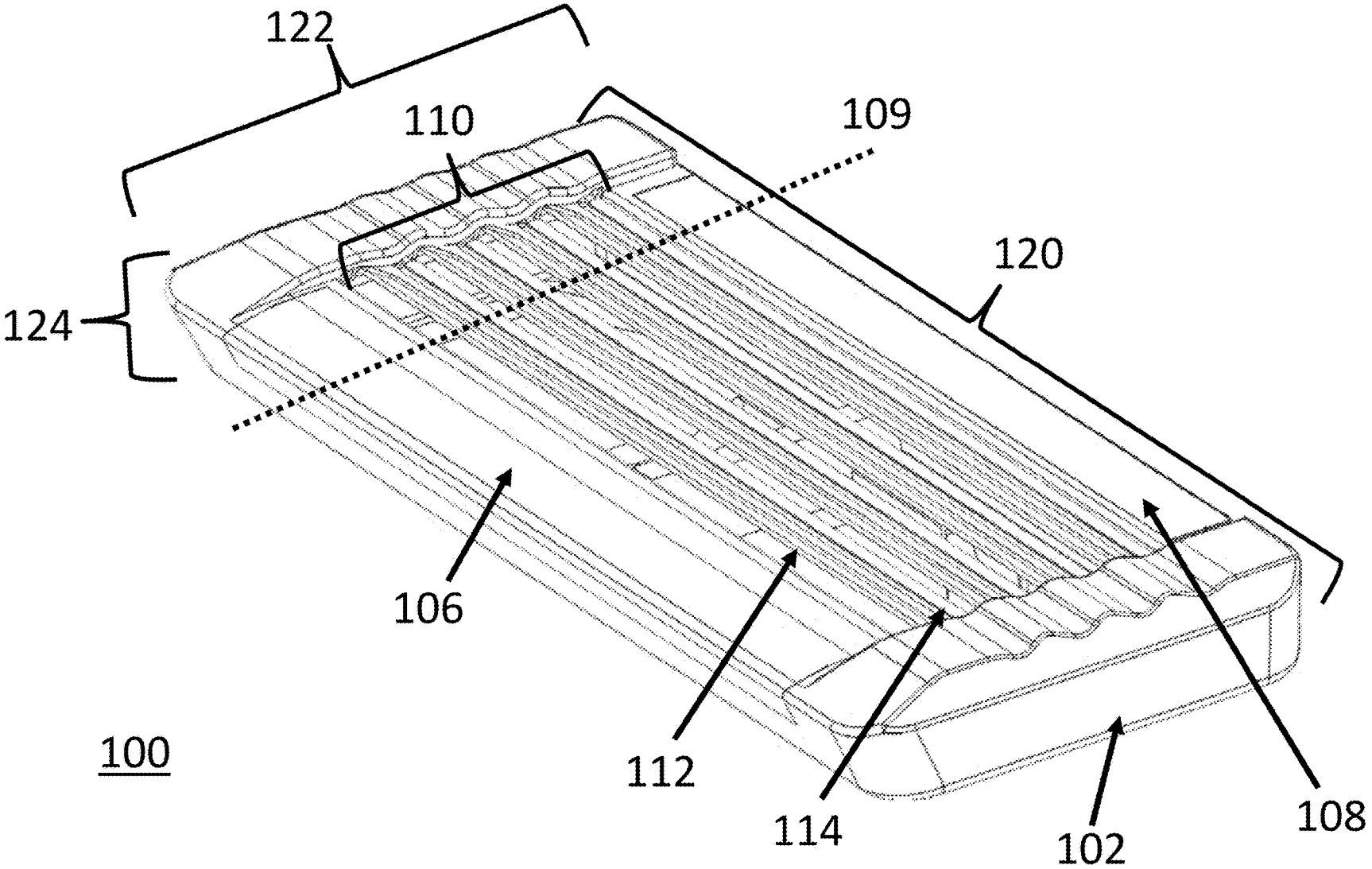
FIG. 1 is a perspective illustration of a razor cartridge when in an upright position according to certain embodiments described here.

Razor cartridges come in all shapes, arrangements, and sizes, but usually have the same main component parts. FIG. 1 shows a perspective view of an example cartridge 100 including a housing 102 having a length 120, a width 122, and a depth 124. The cartridge housing 102 that has a guard 106 and a cap 108 that generally run along the length 120 of the cartridge housing 102. In some examples, the cap and/or guard extend to the full end of the length 120 of the cartridge housing 102, and in some examples, they do not extend all the way to the ends as shown in FIG. 1.

In some examples, either or both of the guard 106 and the cap 108 may have lubrication features built in or included on them. The cartridge 100 in the example shows a frame 110 mounted in the cartridge housing 102, but described in FIG. 2 there could be other arrangements of blade supports used to secure the blades into the cartridge housing 102. Some example cartridges have intermediary guards 114 spaced between blades 112 that run lengthwise down the cartridge 100, and some do not. The housing 102 supports the blades 112 in many different ways including supporting a frame 110 which in turn supports any number of blades by glue, weld, rivet, friction fit, snap fit, sandwiched, and/or any other ways to secure them in, on, and/or to the frame 110. An example of the frame and blades is discussed in more detail in FIG. 2-3. Other examples do not use a frame but individual supports such as those shown in FIG. 2.

Figure 2:
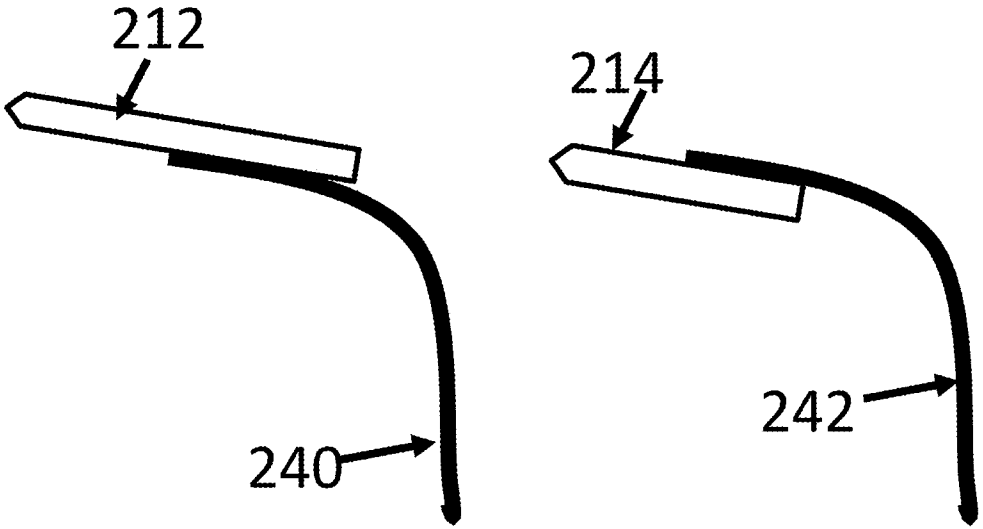
FIG. 2 is an illustration of razor blades and supports according to certain embodiments described here.
Figure 3:
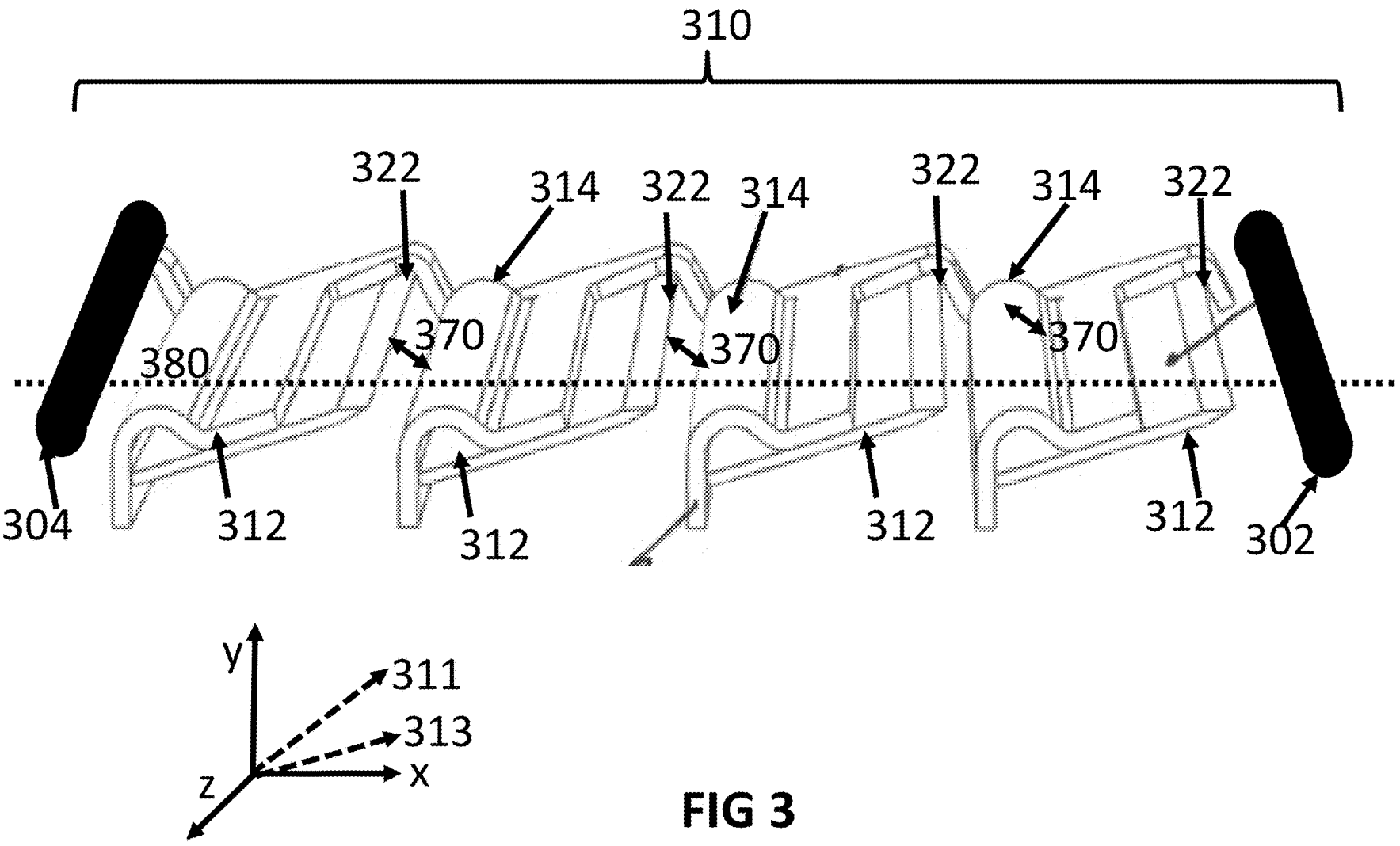
FIG. 3 is an exploded view illustration of a razor cartridge according to certain embodiments described here.

As mentioned, there are razor cartridges that do not use an overall frame system as shown in FIG. 1 but individual supports. FIG. 2 shows an example with a blade 212 affixed to a support 240 that is curved or bent for strengthening purposes different than a unitary frame as shown in FIG. 3. In the example, blade 212 is affixed to the top side of the support 240. FIG. 2 also shows an example of a blade 214 affixed to an underside of a bent support 242. Either examples may be used on any or all of the blades in a cartridge similarly arranged to the frame example in FIGS. 1 and 2. The supports 240, 242 in FIG. 2 may then be secured in, on, or to a cartridge housing (102 in FIG. 1) in order to hold the blades in place during shaving operations, similarly to the description of the cartridge housing 102 securing the frame and blades as described in FIGS. 1 and 2. In yet another example, the blade itself may be formed into the support. In such an example, the blade 212 would not be welded to a support 240 but have a portion that is bent like a support 240, 242 would but be one piece. Any kind of combination, permutation, or other may be used to hold razor blades into a cartridge and support them for use in a shaving operation.

The number of blades in a cartridge could be any number including but not limited to one blade, two blades, three blades, four blades, five blades and six or more blades. The non-limiting examples throughout this description is four blades, but could be any number.

The geometry of the blades 112 in relation to the frame 110 and the guards 114 may include any of various arrangements as described here in order to affect the shaving experience of a user of the razor cartridge 100 as discussed below. A first general discussion of the frame 110 and blade 112 geometry is given below including an exposure of the blades in reference to an imaginary reference line. There are two general ways of describing such an imaginary reference line, the first known as the total or overall reference line 109 is shown in FIG. 1 that runs from cap 108 to guard 106 running the width 122 of a top of the cartridge 100 at the highest points of the cap 108 and guard 106 and the blade edges 112 are measured against that line 109. The second method, or Welsh method of measuring exposure for individual blades against an immediate high point to the front and rear of each blade, is discussed in more detail below, along with other geometry variables.

Geometry Examples

Three example geometry variables will be discussed that can be altered in a razor cartridge to affect a shave for a user. The three main example geometry variables include gap, blade angle, and blade exposure. The interplay of these variables among each other leads to trade-offs in the shaving experience. A less irritating arrangement may not be effective enough for users with tough beards. A very aggressive arrangement may be too harsh for users with sensitive skin. By arranging multiple geometries on a single cartridge, the various advantages may be grouped into one system. The embodiments described here include iterations of these three variables in multiple arrangements to achieve different shaving goals and delivering different shaving experiences to different users.

FIG. 3 illustrates an example cut away view of a frame 310 assembly and blades 312 which are shown affixed to the frame 310. The example could be that of separately supported blades not in a unitary frame, or without intermediary guards, and the example is meant to be illustrative and not limiting.

To help describe the geometry of the configuration, x, y and z axis coordinates are shown in relation to the frame 310 as indicated. The frame 310 example in FIG. 3 includes portions where the blades 312 are attached by weld, glue, rivet, friction fit, sandwich, and/or any other ways. Other examples with separated blades, blades mounted on individual supports are found in cartridges without frames as discussed herein such as FIG. 3. The discussions of geometry apply to any cartridge no matter how the blades are affixed or mounted to the cartridge housing.

In a non-limiting order, one geometry variable is a gap. A gap 370 refers to the gap between a blade edge 312 and the adjacent guard 312, whether that be the front guard or an intermediate guard in the frame, or between blade edges 312 or supports in examples without intermediate guards. The larger the gap 370, the more hair is able to fit in the gap 370 and interact with the blade edge 312. The smaller the gap 370, the less hair is able to fit in the gap, but comfort may be improved. The gap may allow wash through of water and shaving material as well.

Another geometry variable is blade angle. The blade angle refers to the angle at which the blades 312 are positioned in the cartridge and interact with the user's skin in a shaving stroke against an imaginary horizontal line. Referring to the angle of the blades 312 to the skin of a shaving user, between 0 (parallel to skin—and about the neutral exposure line 380) to about 17 degrees 313 may be considered less aggressive. Between about 17 degrees 313 up to about 45 degrees 311 may be considered more aggressive. A more aggressive blade angle may lead to a closer cut of hair from the skin in a shaving stroke but it may be more irritating than a less aggressive blade angle. Different users with different beards and skin may prefer different blade angles. Different areas of the body may require different blade angles.

Another geometry variable mentioned above, is blade exposure. Generally, exposure is how far the blade edges stick up from the cartridge and thereby how much they may interact with a shaving surface. In the example of FIG. 3 a reference line 380 is drawn from the highest points of the cap 304 and guard 302. (FIGS. 9A, 9B and accompanying paragraphs discuss the other exposure method, the Welsh method.) Blades that reach the line 380 but do not extend through it are considered neutral or zero exposure. Blades that do not reach the line 380 are considered negative exposure. Blades that extend beyond the line 380 are considered positive exposure. The more the blade edges are exposed, the more they may interact with the skin and hair in a shaving stroke and the more pressure may be applied to the skin and hair by the blades. The less the blade edges are exposed, the less they may interact with the skin and hair in a shaving stroke. Again, as a trade-off, more exposed blades may result in a closer shave but less exposed blades may provide a more comfortable shaving stroke.

Exposure Measurement Methods

One way to measure exposure in a cartridge is that shown in FIG. 3 above, a straight line, or total or overall method drawing a reference line from a from a cap to a guard, and each blade measured against that total reference line. FIGS. 3-8 are shown as examples using this method. In many examples, the reference exposure line may be drawn across the highest points on the top and bottom of the top surface of the cartridge that may interact with the skin of a user, usually a cap and guard.

Figure 4:
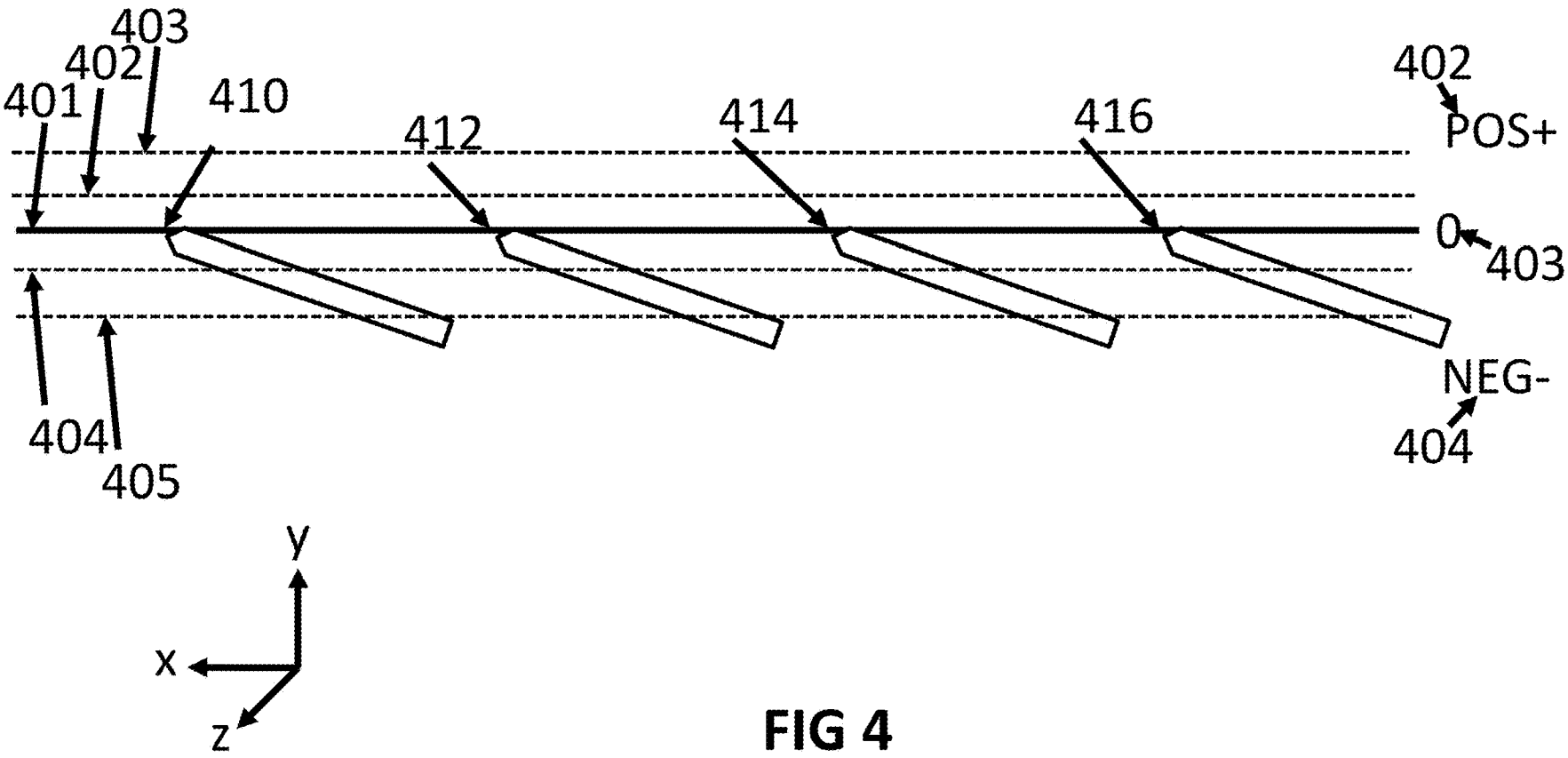
FIG. 4-8 are illustrations of razor blades and reference lines according to certain embodiments described here.

FIG. 4 shows an example cutaway view of multiple razor blades 410, 412, 414 and 416 their exposures as compared to a reference line 401. The reference lines 402, 403, 404 and 405 could represent any amount of distance, depending on the scale of the analysis such as microns, millimeters, centimeters, or fractions of any of the above. Further, although not labeled in subsequent figures for clarity purposes, the same reference examples apply from FIG. 4 through FIG. 5-8 as well as FIG. 9B.

The example shows the overall method of measuring exposure, and the reference line 401 is assumed to be touching the top most parts of a cap and guard (not shown in FIG. 4 but shown in FIGS. 5-8 and 9B). As can be seen from the dashed reference lines showing positive 402, neutral 403 and negative 404 exposure, the example of FIG. 4 shows all neutral blades 410, 412, 414 and 416.

Figure 5:
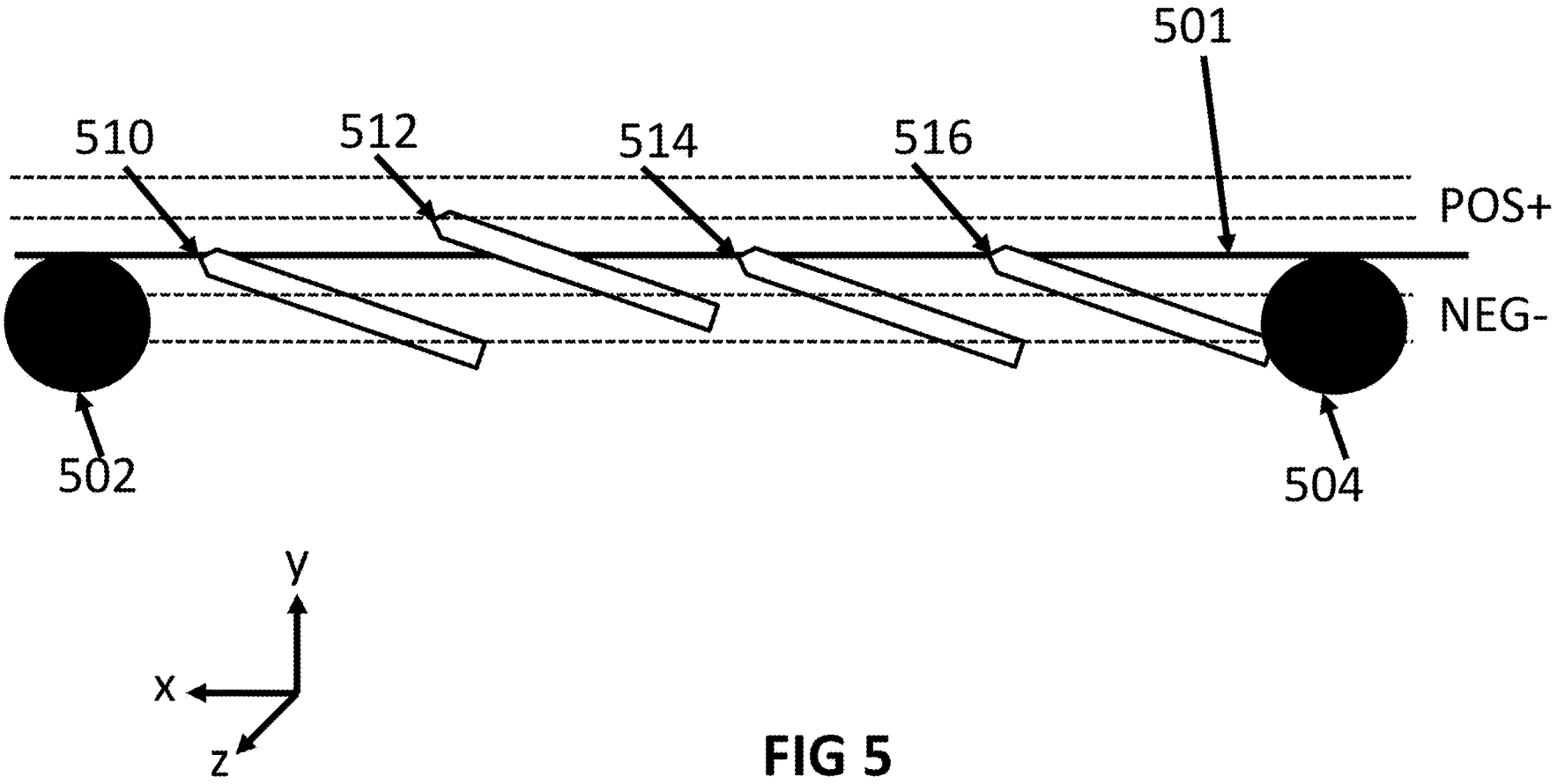

FIG. 5 shows the example side view of exposure using the reference line 501 drawn from the top of the cap 502 and guard 504. The representative blades, caps, guards, etc. in FIGS. 5-8 and 9B are representative to indicate exposure examples, and may not be to scale for spacing, size, and other dimensions. The representative shapes are intended to be explanatory and not limiting in any way.

Figure 6:
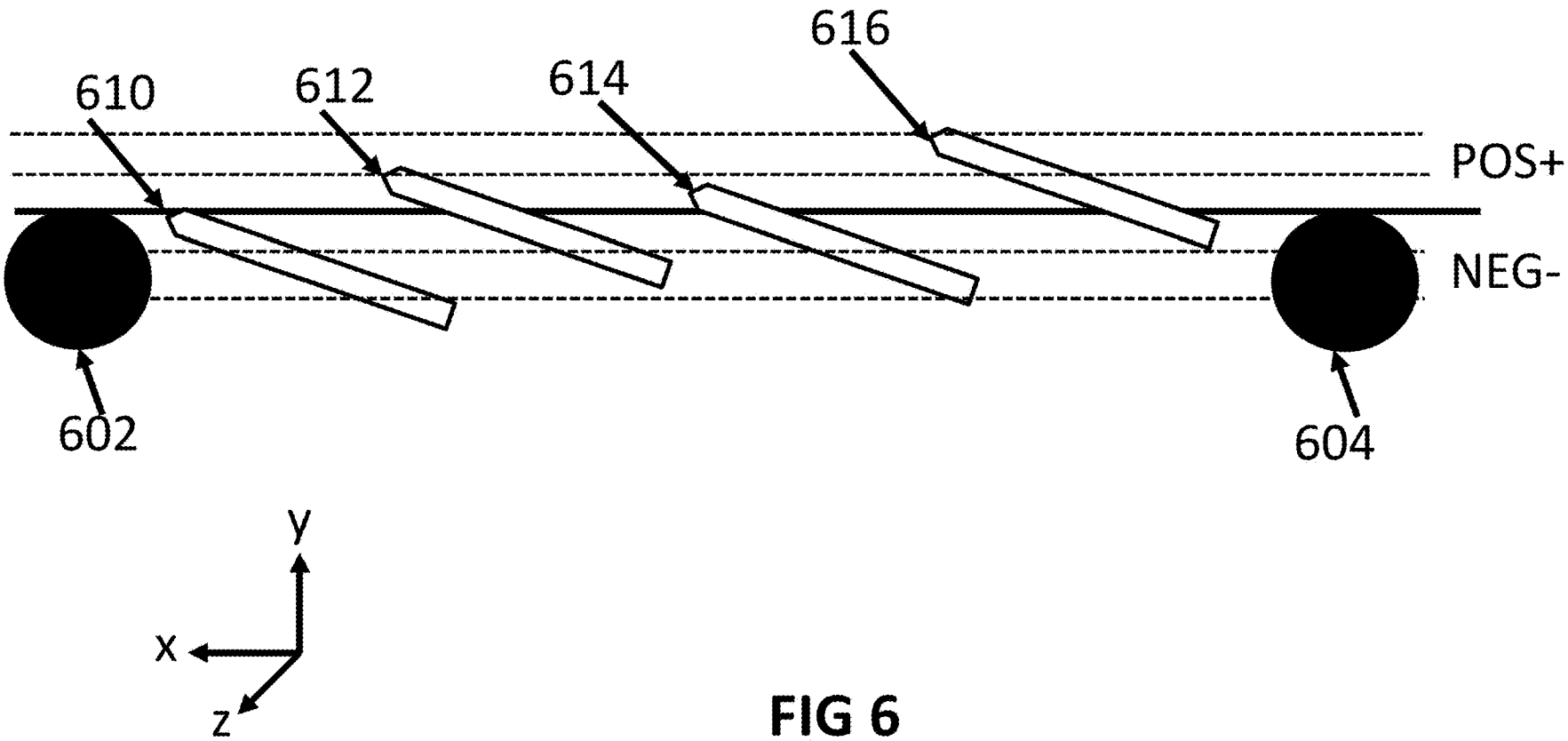
Figure 7:
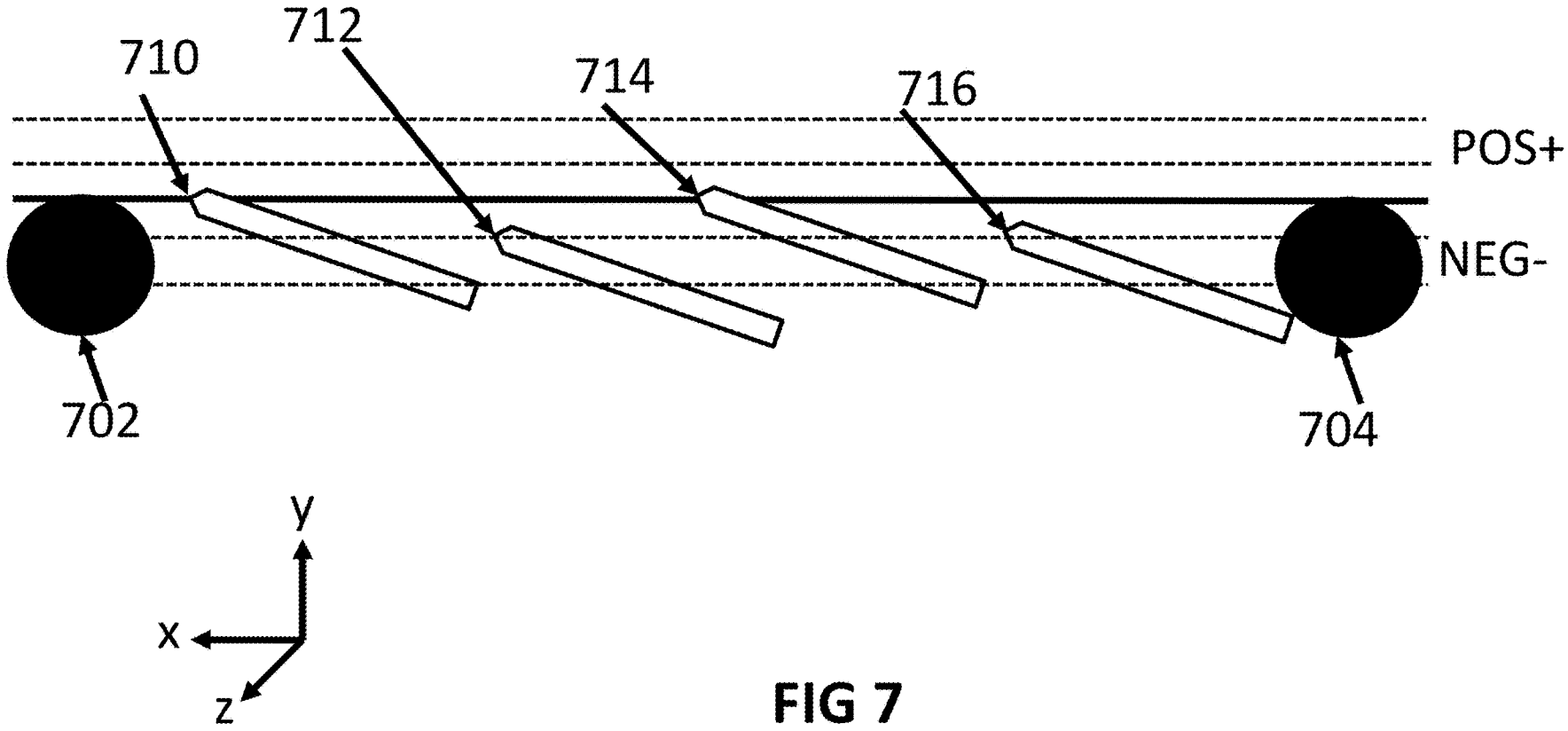
Figure 8:
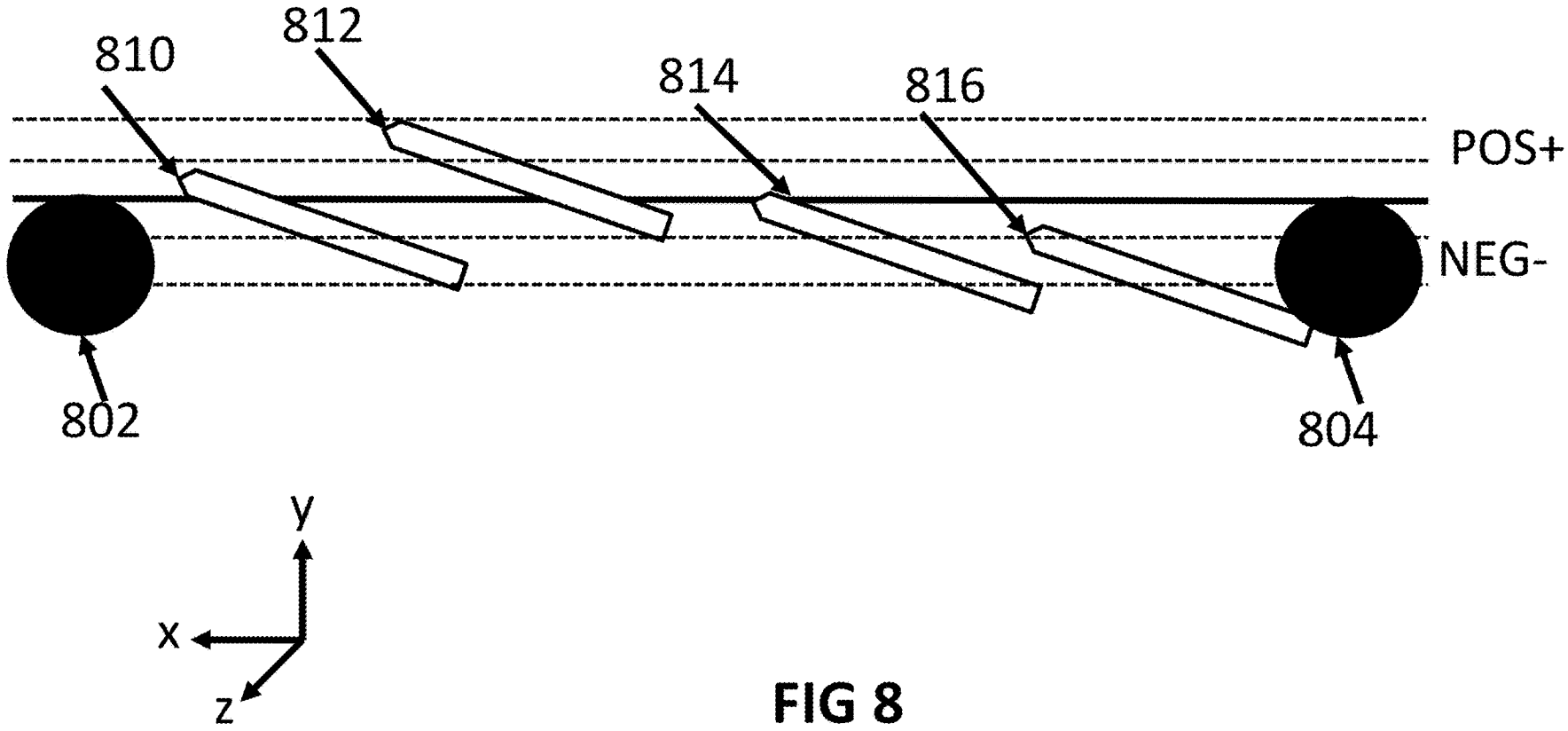

FIG. 5 shows an example of the first blade behind the guard 502 as neutral 510, second blade slightly positive 512, third 514 and fourth blades 516 just in front of the cap 504 as generally neutral. FIG. 6 shows an example with the first blade 610 neutral just behind the guard 602, second blade slightly positive 612, third blade 614 less positive than the second blade but still positive, and fourth blade 616 just in front of the cap 604 as much more positive exposure than the second or third blades. FIG. 7 shows an example where the first blade is slightly positive 710 just behind the guard 702, second blade is negative 712, third blade is generally neutral 714 and fourth blade is negative 716 just in front of the cap 704. FIG. 8 shows an example where the first blade 810 is slightly positive just behind the guard 802, second blade is much more positive 812, third blade is generally neutral 814 and fourth blade 816 is negative, just in front of the cap 804.

Figure 9A:
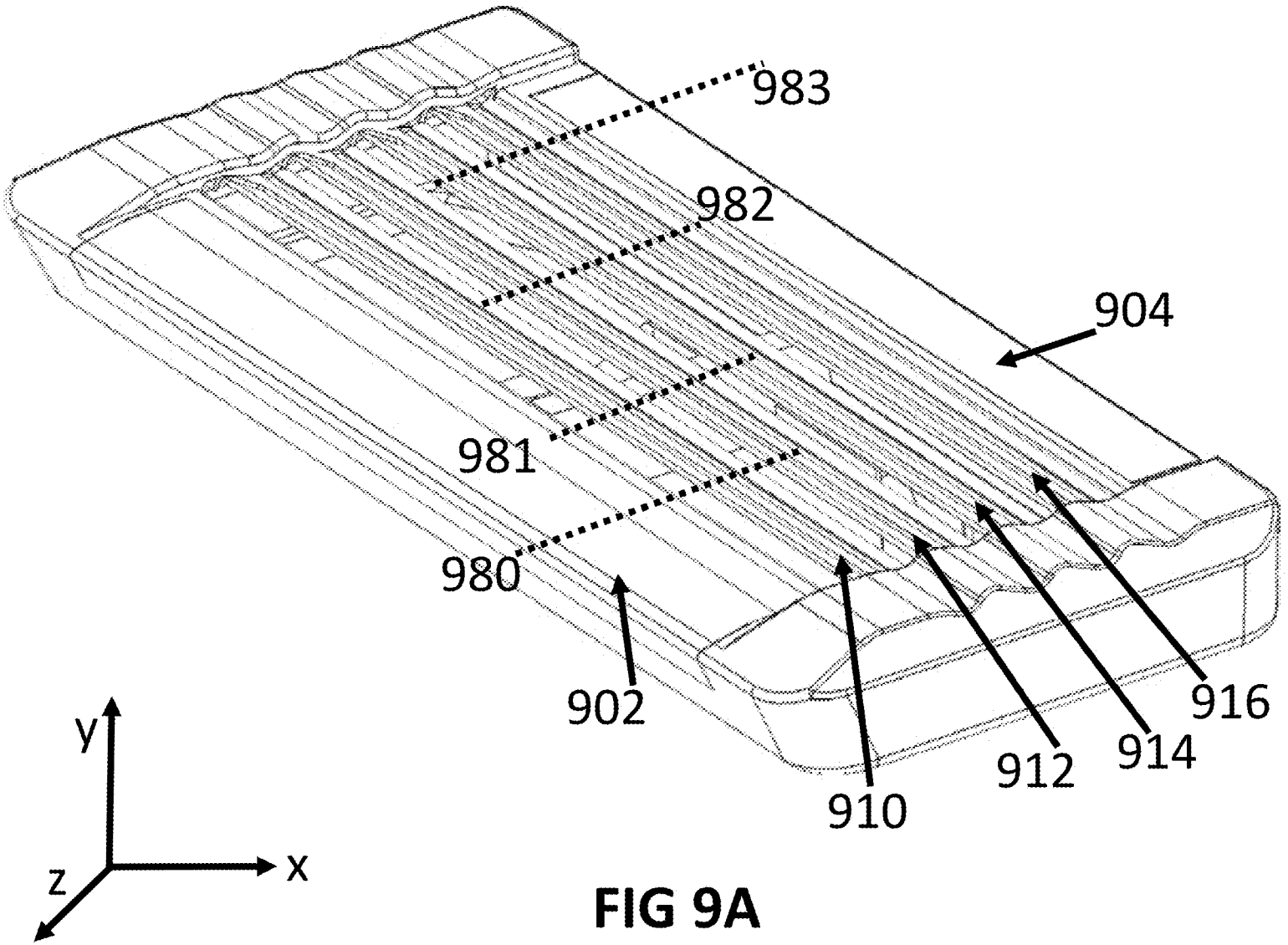
FIG. 9A is a perspective illustration of a razor cartridge and reference lines according to certain embodiments described here.
Figure 9B:
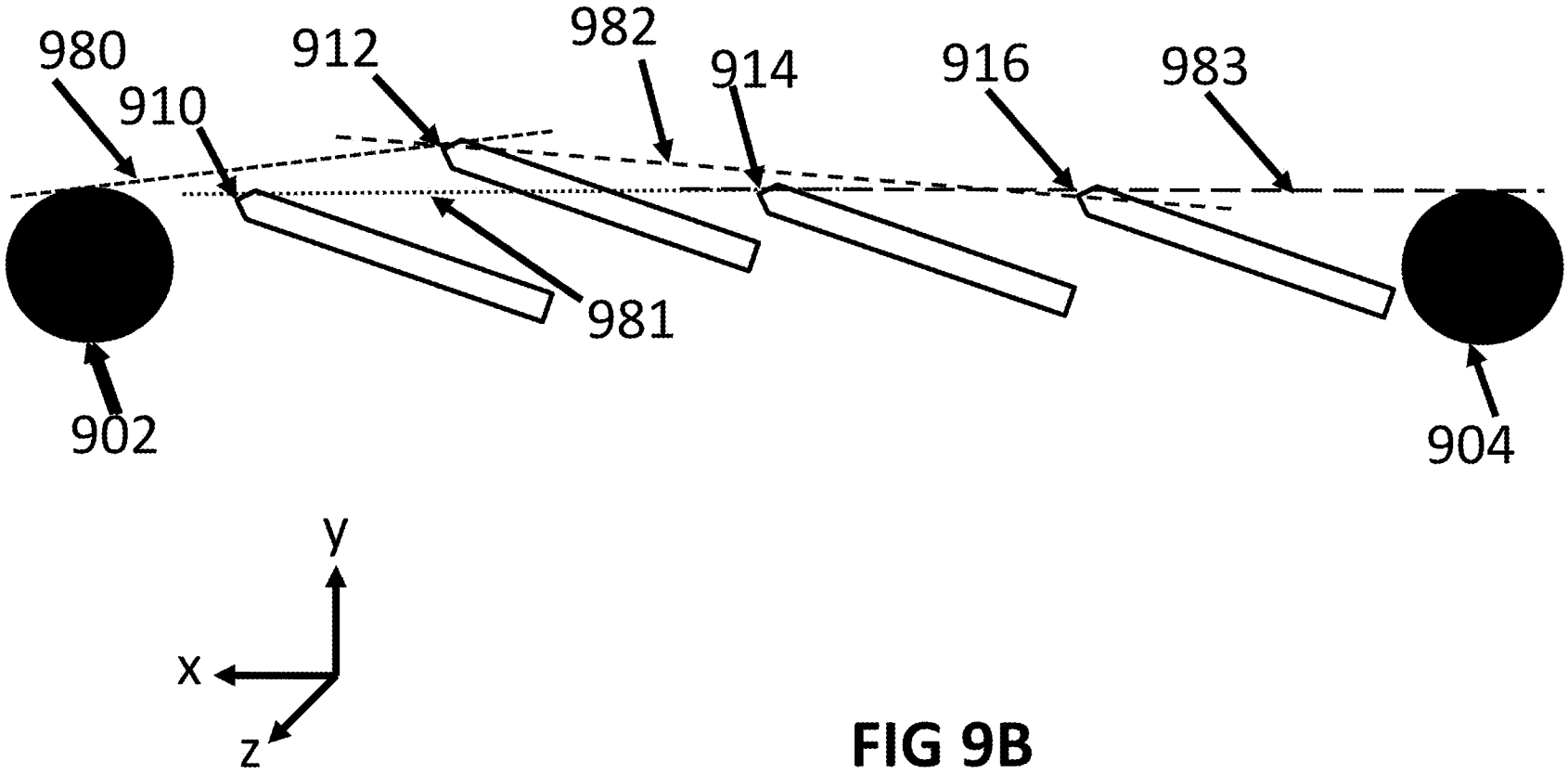
FIG. 9B is an illustration of a razor cartridge and reference lines according to certain embodiments described here.

Although FIG. 3-8 show one way to measure exposure, a total or overall method to draw a single line between cap and guard and measure blade distance to that line, there are two general methods of measuring exposure may be utilized. In the second method, known as the Welsh Method as shown in FIGS. 9A and 9B, exposure is measured between the two nearest successive or immediate high points nearest the blade in question in a multi bladed razor. These immediate high points may be another blade in a multi blade cartridge, and/or if a cartridge has a cap 904 at the top and a guard 902 at the other end, reference may be made to in front of a blade, toward the guard 902 and behind a blade toward the cap 904. Measuring this way may result in different exposure findings than the overall or total cap-to-guard method mentioned above in FIG. 1 using one line to measure against.

Using the Welsh method, the two nearest points of the blade in question may be the cap, guard, or another blade in front of or behind the blade in question. In some examples, the first blade 910 may be measured with a line 980 extending form the guard 902 to the second blade 912. The second blade 912 may be measured with a reference line 981 between the first blade 910 and third blade 914. The third blade 914 may be measured using a reference line 982 between the second blade 912 and fourth blade 916. The fourth blade 916 may be measured using a reference like 983 between the third blade 914 and cap 904. In examples with fewer or more blades, a similar measurement system may be used, measuring between the nearest blade, cap or guard for each blade in a cartridge.

FIG. 9B shows a cutaway view of the blades in the cartridge in FIG. 9A measured using the Welsh method of examining the surfaces before and after a blade under analysis to determine a reference line. In the example, the guard 902 and second blade 912 are used to draw a reference line 980 for the first blade 910 showing the first blade 910 is slightly negative. The first blade 910 and third blade 914 are used to draw a reference line 981 for the second blade 912 which is positive. The second 912 and fourth blades 916 are used to draw a reference line 982 for the third blade 914 which is slightly negative. The third blade 914 and cap 904 are used to draw a reference line 983 for the fourth blade 916 which is generally neutral. Again, any number of blades may be measured this way as an alternative to measuring how FIGS. 9A and 9B are measured above.

Figure 11:
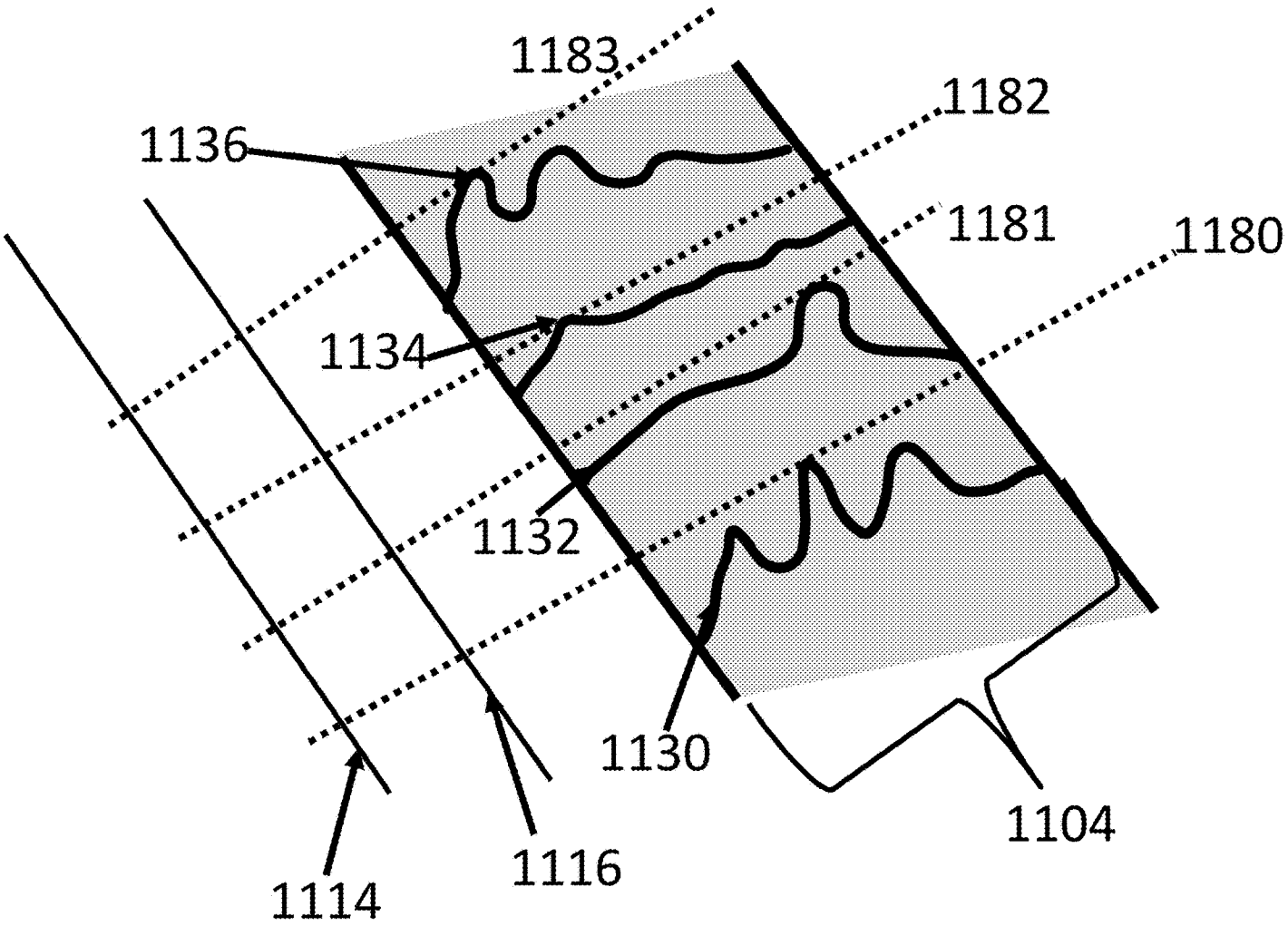
FIG. 11 is a perspective illustration of a razor cartridge cap and reference lines according to certain embodiments described here.

And as can be seen from the example, the results of exposure analysis and measurement may be different using the Welsh method than the total method, as in FIG. 11 which would be considered Neutral, Positive, Neutral, Neutral using the total method and Negative, Positive, Negative, Neutral using the Welsh method.

Some example exposure arrangements that may be used include, but are not limited to those shown in the figures above, as well as, but not limited to a progressively more positive exposure arrangement, a progressively more negative exposure arrangement, a neutral arrangement, a first blade positive exposure, a first blade negative exposure, a last blade negative exposure, two middle blades neutral exposure, two consecutive blades with the second more positive exposure, three consecutive blades, with each successive blade more positive exposure, alternating positive/negative exposure on successive blades, descending exposure on successive blades, first blade neutral, and/or any and all combinations of the above, those in the figures, or any other example of exposure, these not intended to be limiting.

Exposure Variations in a Cartridge

Figure 10:
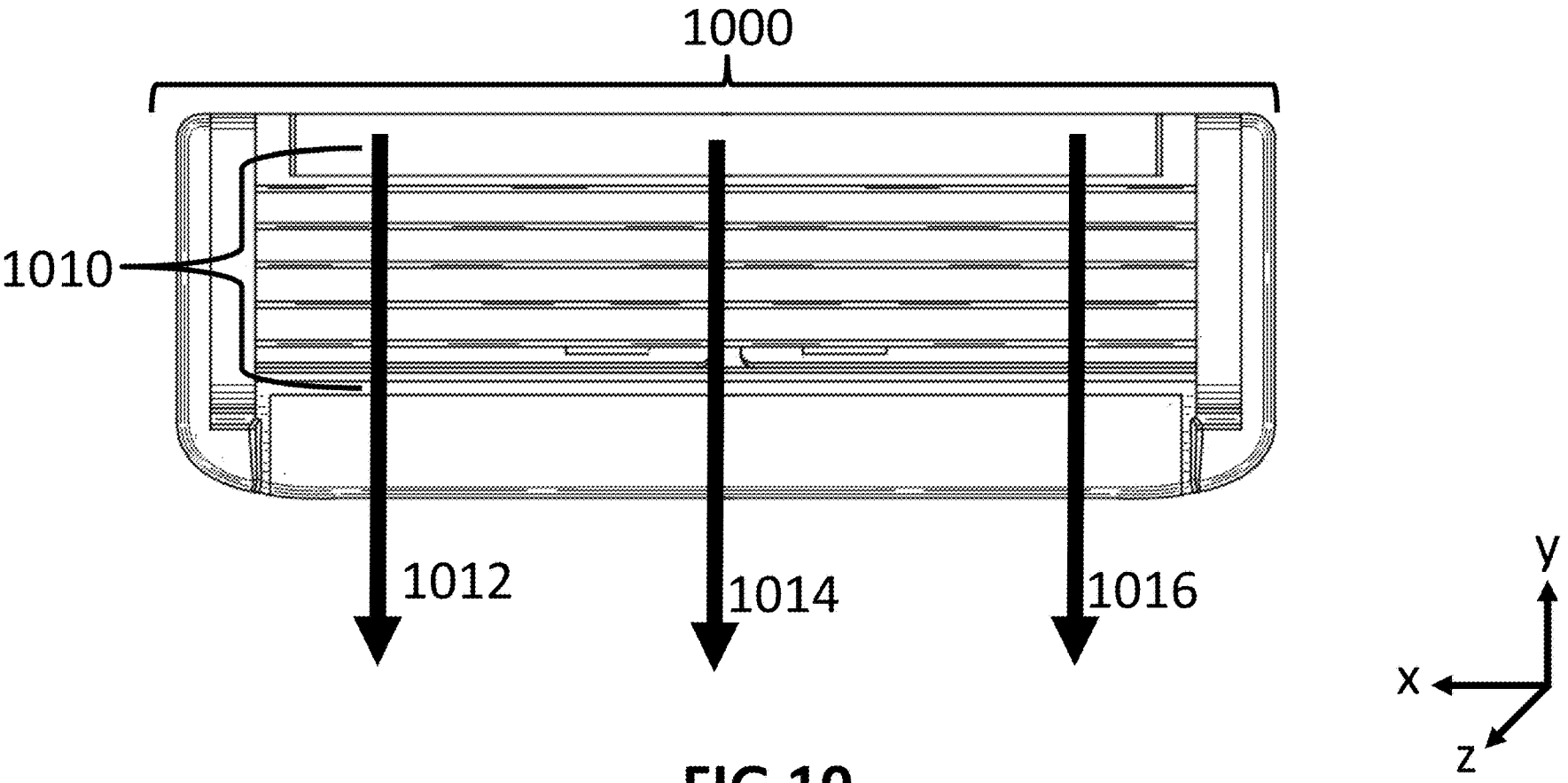
FIG. 10 is a perspective illustration of a razor cartridge and reference lines according to certain embodiments described here.

The descriptions above discuss exposure of a cartridge by examining a cut away side view of the cap, guard, and blades between the two, using two methods of reference lines. But it should be pointed out that by examining the exposure in such a way, only examines exposure at one place, drawn across the cartridge from top to bottom. There are examples of a single cartridge displaying different exposures for the blades, if measured at different points or lines on the cartridge. FIG. 10 shows an example cartridge 1000 with a span of multiple blades 1010. The cartridge 1000 includes cutaway sections drawn across different places on the cartridge such as the far left side 102, toward the middle 1014 and the right side 1016. Any number of places could be measured for exposures, by examining the exposure across different lines along a cartridge body.

In some examples, it may be advantageous to have all of the exposures across the body of a cartridge be the same or nearly the same. Singular exposures across a single cartridge may be beneficial for some designs. However, it may be beneficial to vary the exposure across a single cartridge, even if those variances are relatively small. Such a variance in exposure may more closely match geometry of a surface being shaved, such as skin of a user. In some examples, it may be beneficial to allow for blades to bend, move, and/or otherwise flex in order to alter or change exposure setting during use. More examples and details are given herein discussing the variables and nuances of these exposures.

In some examples, it may be advantageous to have all or some of the exposures across the body of a cartridge be different at different places. In other words, it may be advantageous to include a razor cartridge with a single blade that exhibits different exposures on different parts of the cartridge. It may be advantageous to include multiple blades on a cartridge that exhibit different exposures on different parts of the cartridge. In such examples, exposures measured at 1012 may be different than those measured at 1014 and/or 1016, and/or any other place measured on the cartridge. These exposures may be different no matter which method of exposure analysis is utilized, as described above.

The example of FIG. 10 showing exposures measured at three different places, 1012, 1014 and 1016 is not intended to be limiting. Exposures could be measured many different places across a cartridge width, at any distance from the next measurement.

Scope and Scale

One example item to note is scope or scale of the measurements, and their effect on where an exposure reference line is drawn between (cap and guard or between two closes points near blades, etc.), because the imaginary reference line may be drawn and compared to the blade edges, exposure examples described above may be affected by the scope or granularity used in measuring exposure. In some examples, measurements may be made to the smallest degree technologically possible with electron microscopes and computer graphics analysis. In such examples, measurements to the micron scale may be used to determine exposure.

In some examples, a more simple and less accurate measurement may be made using physical tools such as a straight edge to observe exposure using the human eye. In such examples, a physical straight edge may be placed against the cap and guard and an observation may be made as to whether the blades touch the straight edge, do not touch the straight edge, or generally rest along the straight edge to determine exposure.

Any range of measurements from electron microscope, optical microscope, magnifying glass, to human eye, may be utilized to measure exposure in different scenarios due to the application and purpose they are meant to serve, providing a shaving experience for a user.

Yet another consideration is the imaginary reference line itself. In some examples, a line may be drawn from cap to guard on the physical cartridge or an image captured by a computer, laser, camera, and/or film. But at a close scale, it may be found that the materials that make up the cap and/or guard are not uniformly flat, and that the heights vary across the materials. In some examples, the cap and/or guard may be bumpy, include grooves, include features, or be made of material that is not uniform or flat when viewed by an electron microscope, optical microscope, laser or other device. In such examples, for each measurement, 1012, 1014, and/or 1016, the reference line may start or end on a different height than the reference line next to it or on another part of the cartridge.

FIG. 11 shows an example close up view of a lubrication strip cap 1104 example where the surface of the strips is bumpy and not uniformly smooth. Such a close up may require a microscope, laser microscope, and/or other specialized instruments that can view surfaces at an enlarged scale. In such examples, a lubrication strip may look generally flat to the naked eye, but under closer inspection, may include ridges, valleys, peaks, and hills all along the length of the strip.

The example of FIG. 11 shows different shapes 1130, 1132, 1134, 1136 when viewed as a cutaway at different places along the cap strip. Because of these height variations of the cap, the resulting drawn reference lines 1180, 1181, 2282, 1183 and thereby the exposure measurements of the closest blade 1116 will differ from place to place. And it may differ based on which point along the lubrication strip features is chosen to draw the reference line. In such examples, one portion of the cap 1130 may include undulations, peaks, valleys, higher and lower portions just within itself. Measurements taken from the highest peak may differ from those referenced against the lowest valley, or other features in between. Still other methods of drawing a reference line may include use of averages of the peaks and valleys to place a reference line. But again, an average at 1134 may be different than that at another portion 1130 for example. Many different reference lines 1180, 1181, 1182, 1183 may be drawn and then measured against.

This is the case no matter which method of exposure line drawing is used, Welsh or overall total method as the other end of the reference line 1180, 1181, 1182, 1183 that is not on the bumpy cap 1104 touches either another blade 1114 or guard bar (not shown for scale). Although for the Welsh method, it may only affect the measurement to the blade closest the bumpy surface, such as the last blade in the cartridge 1116. But in an overall total method, it would result in different positioning of the reference lines for each measurement for all blades.

In such examples, measurements from one part of the strip may produce exposure results that are different than a measurement just to the side or on another part of the cartridge.

Besides examples where the cap is made of a bumpy material, the material itself may change over time, thereby changing the exposure line resting on different heights of lubrication strip across the cartridge thereby affecting measurements. In such examples, the cap may be made of material, or have impregnated in it, material that degrades, washes away, dissolves, or otherwise changes during shaving operations because it includes lubrication materials. In some examples the material on or in the lubrication strip may swell when exposed to water. In such examples, the physical height of the strip may thereby change when the material dissolves or is washed away making a measurement of exposure before and after use different because the height of the material against which the reference line is drawn moves or changes.

Likewise, the guard may include ridges or bumps or be made of water soluble material, that may change the position of a reference line and thereby the exposure measured every few microns across the width of a cartridge. The caps and/or guards and/or blades may be coated with any kind of material to ease friction or aid in standing up hairs for closer cuts, such as chrome, polytetrafluoroethylene PTFE, plastics, paint, lacquer, or other coatings, changing the position of the reference line across the cartridge. Any or all of such examples in any combination may affect the drawing of a reference line against which blade exposures may be measured.

CONCLUSION

The foregoing description, for purpose of explanation, has been described with reference to specific embodiments.

However, the illustrative discussions above are not intended to be exhaustive or to limit the embodiments to the precise forms disclosed. Many modifications and variations are possible in view of the above teachings. The embodiments were chosen and described in order to best explain the principles of the embodiments and its practical applications, to thereby enable others skilled in the art to best utilize the various embodiments with various modifications as are suited to the particular use contemplated.

Unless the context clearly requires otherwise, throughout the description, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Although certain presently preferred implementations of the embodiments have been specifically described herein, it will be apparent to those skilled in the art to which the embodiments pertains that variations and modifications of the various implementations shown and described herein may be made without departing from the spirit and scope of the embodiments. Accordingly, it is intended that the embodiments be limited only to the extent required by the applicable rules of law.

What is claimed is:

1. A shaving razor, comprising:

a cartridge housing, when in an upright position, having a length and a width, a topside and an underside, wherein the cartridge housing includes a cap generally across the length of a first side of the topside and a guard generally across the length of a second side of the topside, wherein the cartridge housing includes at least two substantially flat blades in the cartridge housing generally across the length of the housing between the cap and the guard, and generally parallel to the cap and the guard, each of the at least two blades including a blade edge, wherein exposure is measured for each of the at least two blade edges against a first and second parallel imaginary exposure reference line drawn across the top side of the cartridge width from the cap to the guard, and wherein exposure of a first blade of the at least two blades is different at the first imaginary exposure reference line of the two locations along the length of the cartridge, from the second imaginary exposure reference line of the two locations along the length of the cartridge, wherein exposure of a second blade of the at least two blades is different at the first imaginary exposure reference line of the two locations along the length of the cartridge, from the exposure of the first blade of the at least two blades at the first imaginary exposure reference line of the two locations.

2. The shaving razor system of claim 1 wherein, the at least two blades mounted into the cartridge housing is with a unitary frame.

3. The shaving razor system of claim 1 wherein, the at least two blades mounted into the cartridge housing is by individual razor supports.

4. The shaving razor system of claim 1 wherein, the cap is made of a lubricious material.

5. The shaving razor system of claim 1 wherein, the cap does not have a uniform flat surface.

6. The shaving razor system of claim 1 wherein, the guard includes ridges.

7. The shaving razor system of claim 1 wherein, the blades are coated in PTFE.

8. A shaving razor, comprising:

a cartridge housing, when in an upright position, having a length and a width, a topside and an underside, wherein the cartridge housing includes a cap generally across the length of a first side of the topside and a guard generally across the length of a second side of the topside, wherein the cartridge housing includes at least three substantially flat blades in the cartridge housing generally across the length of the housing between the cap and the guard, and generally parallel to the cap and the guard, each of the at least three blades including a blade edge, wherein exposure is measured for each of the at least three blade edges against a first and second parallel imaginary exposure reference line drawn across the top side of the cartridge width from the cap to the guard, and wherein exposure of a first blade of the at least three blades is different at the first imaginary exposure reference line of the two locations along the length of the cartridge, from the second imaginary exposure reference line of the two locations along the length of the cartridge, wherein exposure of a second blade of the at least three blades is different at the first imaginary exposure reference line of the two locations along the length of the cartridge, from the exposure of the first blade of the at least two blades at the first imaginary exposure reference line of the two locations, and wherein exposure of the third blade of the at least three blades is different at the first imaginary exposure reference line of the two locations along the length of the cartridge, from the second imaginary exposure reference line of the two locations along the length of the cartridge.

9. The shaving razor system of claim 8 wherein, the at least two blades mounted into the cartridge housing is with a unitary frame.

10. The shaving razor system of claim 8 wherein, the at least three blades mounted into the cartridge housing is by individual razor supports.

11. The shaving razor system of claim 10 wherein, the cap is made of a lubricious material.

12. The shaving razor system of claim 11 wherein, the cap does not have a uniform flat surface.

13. The shaving razor system of claim 10 wherein, the guard includes ridges.

14. The shaving razor system of claim 8 wherein, the blades are coated in PTFE.

15. A shaving razor, comprising:

a cartridge housing, when in an upright position, having a length and a width, a topside and an underside, wherein the cartridge housing includes a cap generally across the length of a first side of the topside and a guard generally across the length of a second side of the topside, wherein the cartridge housing includes at least three substantially flat blades in the cartridge housing generally across the length of the housing between the cap and the guard, and generally parallel to the cap and the guard, each of the at least three blades including a blade edge, wherein exposure is measured for each of the at least three blade edges against a first and second parallel imaginary exposure reference line drawn across the top side of the cartridge width from the cap to the guard, and wherein exposure of a first blade of the at least three blades is different at the first imaginary exposure reference line of the two locations along the length of the cartridge, from exposure of a second of the two imaginary exposure reference line locations along the length of the cartridge, wherein exposure of a second blade of the at least three blades is different at the first imaginary exposure reference line of the two locations along the length of the cartridge, from the second imaginary exposure reference line of the two locations, and wherein exposure of a third blade of the at least three blades is different at the first imaginary exposure reference line of the two locations along the length of the cartridge, from the exposure of the first blade of the at least two blades at the first imaginary exposure reference line of the two locations, and different from the second imaginary exposure reference line of the two locations.

16. The shaving razor system of claim 15 wherein, the at least three substantially flat blades is four substantially flat blades.

17. The shaving razor system of claim 15 wherein, the at least three substantially flat blades is six substantially flat blades.

18. The shaving razor system of claim 15 wherein, the at least three blades mounted into the cartridge housing is by individual razor supports.

19. The shaving razor system of claim 18 wherein, the cap is made of a lubricious material.

20. The shaving razor system of claim 19 wherein, the cap does not have a uniform flat surface.

* * * * *